US008844784B2

(12) United States Patent
Bouma et al.

(10) Patent No.: US 8,844,784 B2
(45) Date of Patent: Sep. 30, 2014

(54) CONTROLLING DRIVE SETTINGS IN A PRESS

(75) Inventors: Timothy Jay Bouma, Corvallis, OR (US); Whitney Elaine Loper, Corvallis, OR (US); George Joseph Shrum, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 961 days.

(21) Appl. No.: 12/824,988

(22) Filed: Jun. 28, 2010

(65) Prior Publication Data

US 2011/0315036 A1 Dec. 29, 2011

(51) Int. Cl.
*B41J 23/18* (2006.01)

(52) U.S. Cl.
USPC ..... 226/42; 400/618; 347/5

(58) Field of Classification Search
USPC ..... 400/618; 242/57.1; 226/42; 347/5, 16
See application file for complete search history.

(56) References Cited

U.S. PATENT DOCUMENTS

| | | | | |
|---|---|---|---|---|
| 4,485,982 | A * | 12/1984 | St. John et al. | 242/563.1 |
| 6,106,177 | A * | 8/2000 | Siegl et al. | 400/618 |
| 6,176,410 | B1 | 1/2001 | Ueda et al. | |
| 6,499,639 | B2 * | 12/2002 | Cote et al. | 226/42 |
| 7,542,175 | B2 | 6/2009 | Schutte, III | |

* cited by examiner

*Primary Examiner* — Lam S Nguyen

(57) ABSTRACT

In one embodiment, a method for controlling drive settings in a press for printing on a web of media. A drive is provided to receive the web from an upstream location and to transport the received web downstream of the drive at a controllable speed. The speed of the drive is sampled plural times while operating the drive in a tension control mode that varies the speed to maintain a desired tension in the web adjacent the drive. An optimal speed of the drive is calculated from the sampled speeds. The drive is operated in a constant velocity mode at the optimal speed during printing.

20 Claims, 11 Drawing Sheets

FIG. 6 INITIAL RUN DETERMINING OPTIMUM SPEED

CONTROLLING DRIVE SETTINGS IN A PRESS

BACKGROUND

A web press typically prints on a web of media such as, for example, paper supplied on a roll, that sequentially flows past one or more stations. One station may be, for example, a print station that controllably deposits one or more colorants such as, for example, inks on the media to form a desired printed pattern of a print job. Another station may be, for example, a drying station that heats or otherwise removes a carrier fluid from the colorant. The web of media may flow first through the print station to be printed, then through the drying station for the printed output to be dried. To obtain high throughput, the media flow through the press typically occurs at high speeds such as, for example, about 400 feet per minute off the roll.

Drives disposed at various locations in the press transport the media through the press, by pulling the media at a desired speed from upstream locations. A smooth flow of the web of media through the press contributes to generating printed output that has high print quality. Achieving this smooth flow involves, among other things, determining proper speed settings for the various drives. These proper settings are typically related to the content of the particular print job to be printed. Determining these settings is typically a trial-and-error process involving judgments performed manually by a skilled operator. Many feet of web media may be run through the press and wasted before the proper settings are determined.

DETAILED DESCRIPTION

Figure 1:
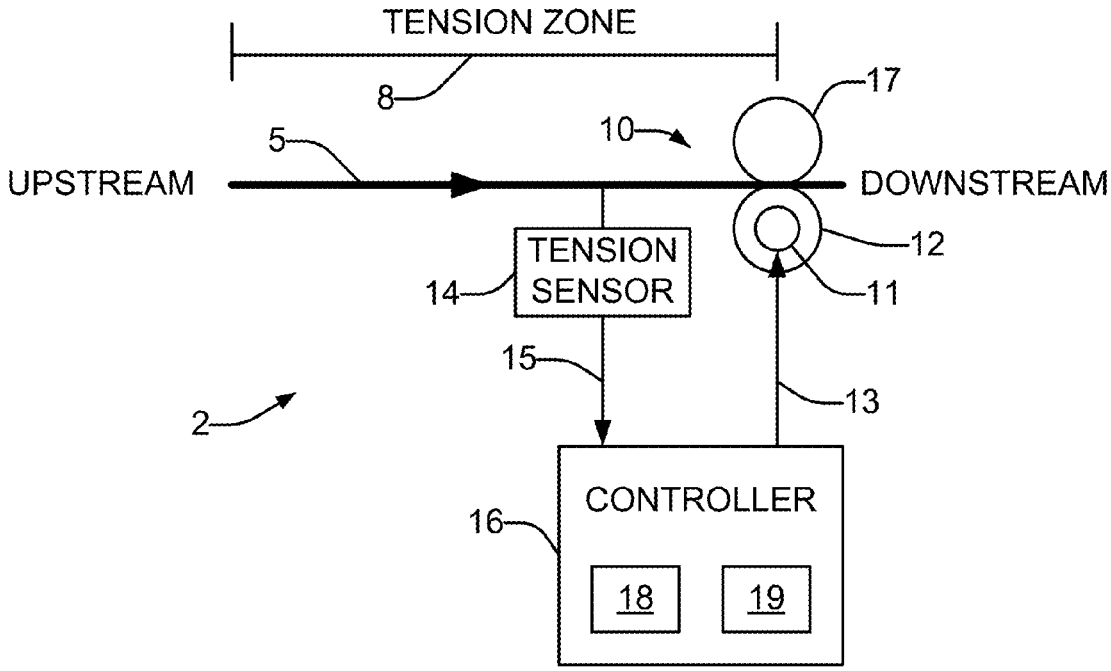
FIG. 1 is a schematic representation of a media handling portion of a web press in accordance with an embodiment of the present disclosure.

Referring now to the drawings, there are illustrated embodiments of a web press for printing on a web of media such as paper, transparency film, or textiles, and embodiments of methods for controlling settings of one or more drives in the press that transport the web of media through the various stations of the press in a manner that generates printed output of high print quality. The media is typically provided to the web press in roll form, and has a particular width that the press accommodates. As defined herein and in the appended claims, a "drive" shall be broadly understood to mean any arrangement that transports the web of media through a region of the press at a controllable speed that is determined by the drive. A "tension sensor" shall be broadly understood to mean any arrangement that measures or senses the tension in the web of media in the vicinity of the sensor. Further, a "tension zone" shall be broadly understood to mean a region of the web of media in which the tension is, or is considered to be, substantially the same, and in which the tension can be maintained at a different value from adjacent tension zones.

As understood with reference to FIG. 1, one embodiment of a web press 2 includes a drive 10, a tension sensor 14, and a controller 16. A web of media 5 is configured to flow through the press 2 in a direction from an upstream location to a downstream location. The web of media 5 may be any type of suitable roll material, such as paper, cloth or other fabric, transparency material, mylar, and the like, but for convenience the illustrated embodiments may be described using paper. The drive 10 is configured to receive the web from the upstream location, and advance the received web downstream of the drive 10 at a controllable speed determined by the drive. The tension sensor 14 is configured to measure the tension in the web 5 in the vicinity of the sensor, which defines the tension attributed to a tension zone 8 that includes the sensor 14 and the drive 10. In some embodiments, the tension zone 8 spans the region from the drive 10 upstream to a prior drive (not shown). An adjacent tension zone (not shown) begins immediately downstream of the drive 10.

The drive 10 typically includes a driven roller 12, which is mounted to, or coupled in another manner to, a drive motor 11. One suitable drive motor 11 is induction motor, part number 1PH7107-2DD02-0BA3, manufactured by Siemens. Another suitable drive motor is induction motor, part number 1PH7103-2DD02-0BA3, manufactured by Siemens. The drive motor 11 is responsive to a speed signal 13 provided to the drive 10 by the controller 16, and the speed signal 13 causes the motor 11 to rotate. The rotation of the motor 11 in turn causes the driven roller 12 to rotate at a speed which corresponds to the speed signal 13. The outer surface of the driven roller 12 contacts the web of media 5, and imparts linear motion thereto which corresponds to the rotational speed and radius of the driven roller 12. The web of media 5 is held by the drive 10 in a manner which prevents or minimizes slippage of the web through the drive 10 under typical operating conditions. In a nipped drive embodiment, nip roller 17 pinches the web of media 5 between driver roller 12 and nip roller 17 to prevent or minimize slippage. In an un-nipped drive embodiment that omits nip roller 17, the outer surface of the driven roller 12 may comprise a material that provides sufficiently high surface friction of the web 5 to the roller 12. Furthermore, the media path may be deflected at the location drive 10 by a predefined angle such that the web of media 5 wraps around the driven roller 12 a predefined amount, to increase the area of contact between the web 5 and the roller 12, which enhances the ability of the roller 12 to control the media flow without slippage.

The tension sensor 14 is a sensor that senses the tension in the web of media 5, and that outputs a tension signal 15 indicative of the tension in the web of media 5. In one embodiment, the tension sensor 14 includes a roller with a load cell disposed at each end. Each load cell includes a strain gauge-based transducer that outputs an electrical signal that corresponds to the force applied to the cell. One suitable load cell is Cleveland Motion Control Ultra Line, part number MO-13334-10. The web of media 5 is typically wrapped partially around the roller bar such that the roller deflects the media path by a desired angle. As a result, as the tension in the web of media 5 increases or decreases, the force applied by the web 5 to the roller and thus to the load cells also increases or decreases correspondingly, which is reflected in the tension signal 15.

The controller 16 is operatively coupled to the drive 10 and the tension sensor 14. The controller 16 is configured to read the tension signal 15 indicative of the tension in the web 5 from the tension sensor 14, and to provide the speed signal 13 to the drive 10 that controls the drive 10 to advance the web 5 through or past the drive 10 at the speed corresponding to the speed signal 13.

The controller 16 is also configured to sample the speed of the drive 10 plural times while operating the drive 10 in a tension control mode that varies the speed to maintain a desired tension, and to calculate an optimal speed of the drive 10 from the sampled speeds. In some embodiments the controller 16 knows the value of the speed signal 13 at a sampled time, since it is the controller 16 that issues the speed signals 13 to the drive 10. In other embodiments the controller 16 may read the speed from the drive 10. The controller 16 is further configured to set the drive 10 to the optimal speed in a constant velocity mode while printing desired output of high print quality on the web of media 5. The tension control mode and the constant velocity mode will be described subsequently in greater detail.

In various embodiments, the controller 16 may be implemented using hardware, software, firmware, or a combination of these technologies. The controller 16 may include dedicated mechanical and electrical hardware, or a combination of dedicated hardware along with a computer or microprocessor controlled by firmware or software. Dedicated electrical hardware may include discrete or integrated analog circuitry and digital circuitry such as programmable logic device and state machines. Firmware or software may define a sequence of logic operations and may be organized as modules, functions, or objects of a computer program. In some embodiments, these logic operations may correspond to the operations performed by the controller 16 as described above, and may correspond to the schematic flow diagrams that will be described subsequently in greater detail.

In some embodiments, the controller 16 includes a processor 18 and a computer-readable medium such as, for example, a memory 19. Firmware or software may be stored in the memory 19, and accessed by the processor 18 via a communicative coupling between the processor 18 and the memory 19. In some embodiments, the processor 18 acquires and/or generates the tension signal 15 and the speed signal 13. The processor 18 may transform the tension signal 15 into the speed signal 13 that controls operation of the drive 10 to advance the web 5. In such embodiments the processor 18, as programmed by the firmware or software instructions in the memory 19, implements or orchestrates the specific logic operations performed by the controller 16.

The memory 19 may represent multiple memories and may include both volatile and nonvolatile memory and data storage components. Volatile components are those that do not retain data values upon loss of power. Nonvolatile components are those that retain data upon a loss of power. Thus, the memory 19 may comprise, for example, random access memory (RAM), read-only memory (ROM), fixed and removable disk media, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device. Also, the processor 18 may represent multiple processors.

One suitable processor-based controller usable in the press 2 is an industrial PLC controller, Simotion Series D445 drive-based controller, manufactured by Siemens.

Figure 2:
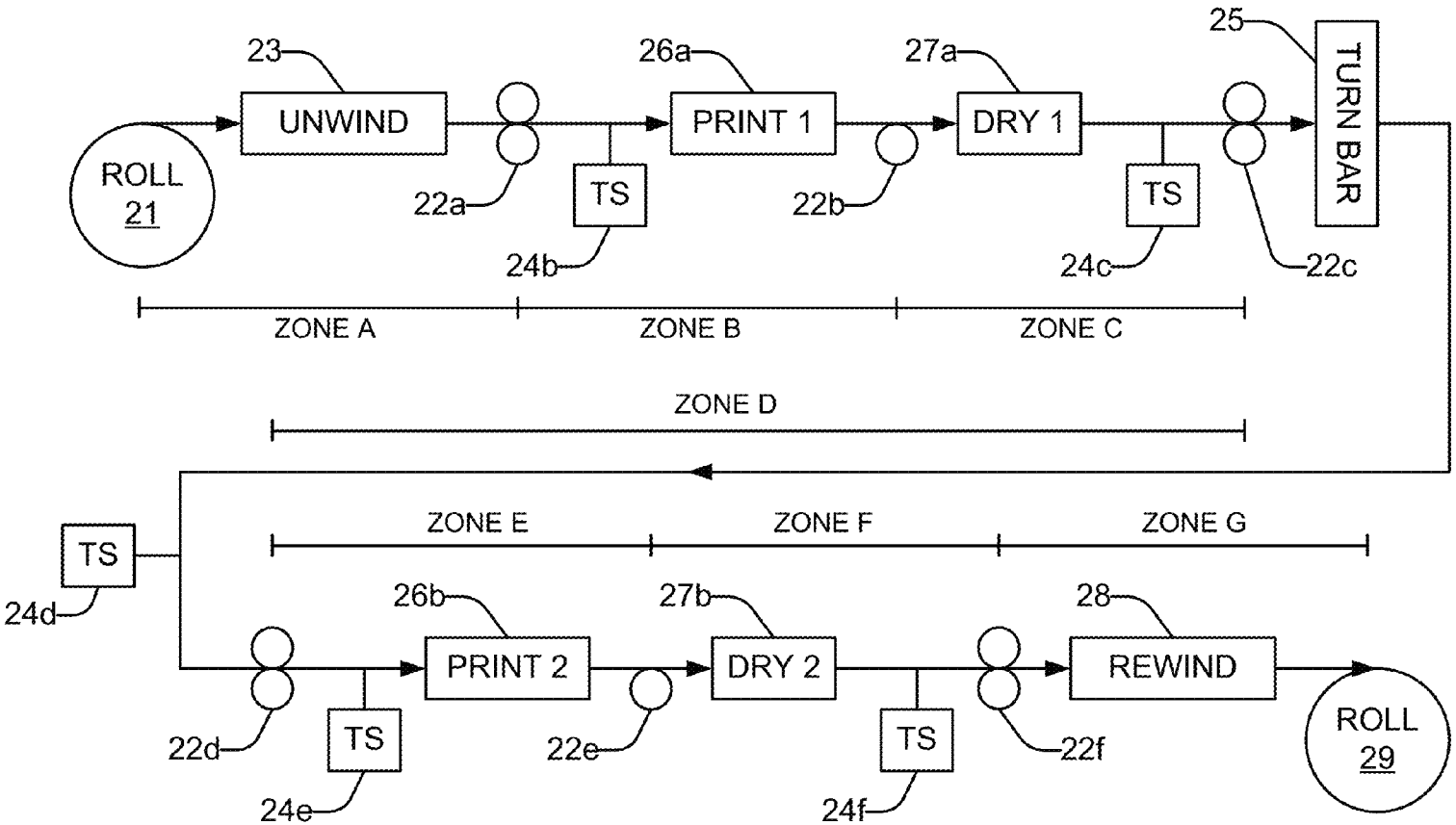
FIG. 2 is a schematic representation of a media flow path of a web press having multiple stations and multiple tension zones in accordance with an embodiment of the present disclosure.

A web press may include a number of tension zones, and thus may include a number of drives and tension sensors. Considering the flow of media along the media path of one such web press 20, and with further reference to FIG. 2, various tension zones and processing stations are cascaded in the press 20. Six drives 22*a-f* define seven tension zones A-G. Each of drives 22*a-f* are the same as or similar to drive 10 (FIG. 1). Five zones B-F each have a corresponding tension sensor 24*b-f*. Tension sensors 24*b-f* are the same as or similar to tension sensor 14 (FIG. 1). Each zone A-G also includes a processing station that performs a certain function with respect to the web of media.

The unwinder processing station 23 plays out the web of media from the roll 21 in tension zone A, applying appropriate force to keep a substantially constant tension on the web as it is played out from the roll 21.

The print section processing station 26*a* prints on a first side of the web of media in tension zone B. In one embodiment, print section 26*a* prints using inkjet technology to deposit water-based inks onto the media. Since the first side of the media is wet after printing, an un-nipped drive 22*b* in contact with the opposite second side of the media may be used in zone B to avoid smearing the ink on the first side.

The dryer processing station 27*a* removes the water from the ink on the first side of the media in tension zone C. In one embodiment, the dryer uses hot air to blow-dry the water on the media; other embodiments may remove the water or moisture in a different or additional manner. Once the first side of the media has been dried, a nipped drive 22*c* may be used in zone C without concern over smearing the ink on the first side. In some embodiments, tension zone C may also include an in-line process control system (not shown) after the dryer 27*a* that performs a quality inspection on the printed media to ensure that, for example, the various inkjet printheads in print section 26*a* were operating properly when the media was printed.

The turn bar processing station 25 in tension zone D is an arrangement of rollers that effectively turns the web of media over, so that the second, opposite side of the web of media may be subsequently printed. A nipped drive 22*d* may be used in zone D.

The print section processing station 26*b* in tension zone E and dryer processing station 27*b* in tension zone F are analogous to print section 26*a* and dryer 27*a* respectively, but print on and dry the second, opposite side of the web of media.

The rewinder processing station 28 takes up the web of media at the end of the media path in tension zone G, applying force to keep a constant tension on the web as it is wound onto the roll 29.

In the web press 20, a particular section of the web of media cascades through the tension zones A-G in sequence. During printing, the speeds of the various drives 22*a-f* are typically different from each other. Part of the difference occurs due to stretching or shrinking of the media as it passes through the various processing stations as will be discussed subsequently, but even where there is no change in dimensionality of the web each successive downstream drive would run slightly faster than its upstream neighbor in order to maintain the desired tension in each tension zone. One way to express the speed of a drive is as a ratio between the speed of the particular drive and the speed of a reference drive. Drive 22*a*, the first drive in the media flow path of the press 20, may typically be considered as the reference drive. During operation of the press 20, the speed of drive 22*a* may be set such that the web of media is fed off the roll 21 at a speed of 400 feet per minute. The controller 16 may manage the operations—including the operating mode (tension control or constant velocity) and the drive speed—of one, some, or all of the tension zones in the press 20.

Figure 3:
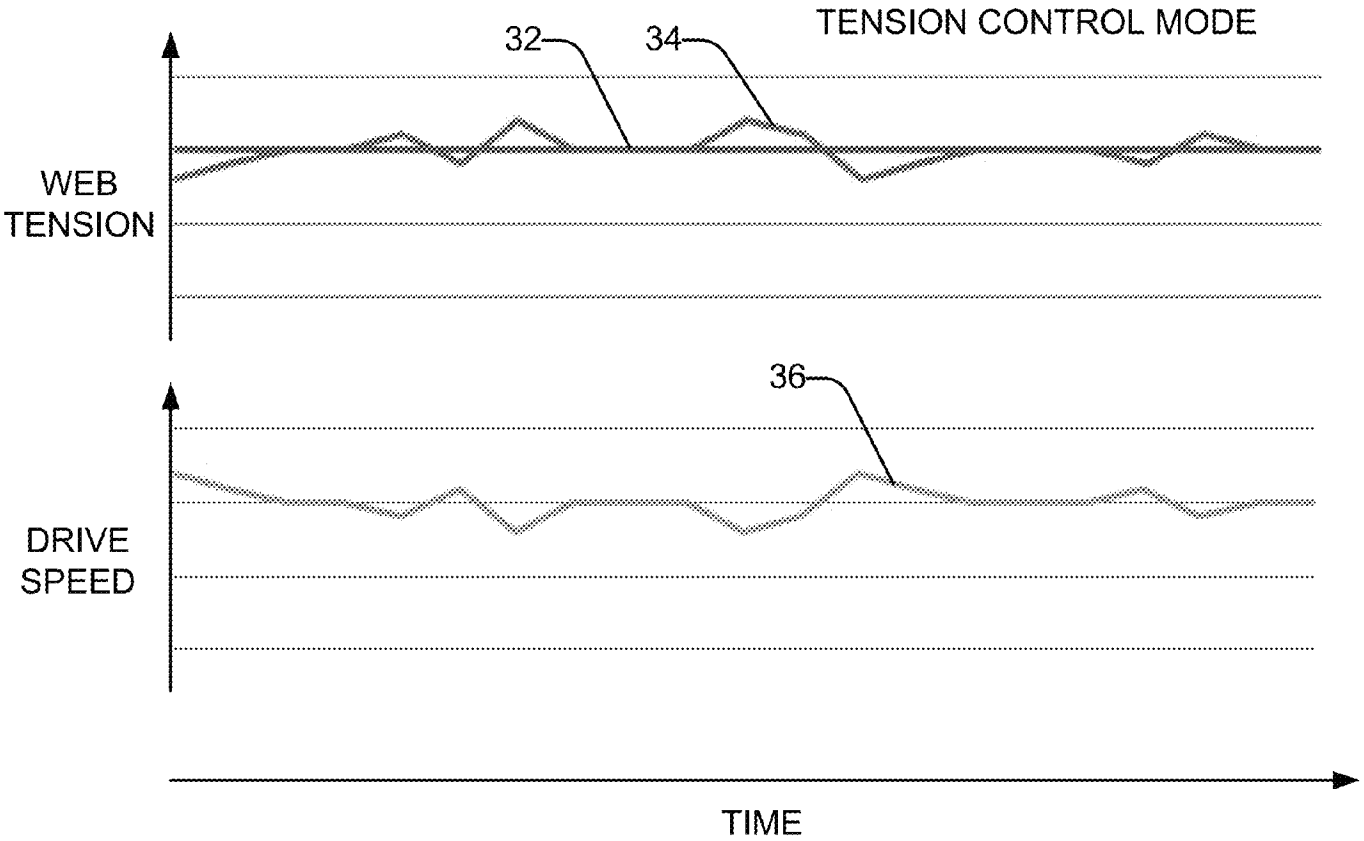
FIG. 3 is an illustration of an example relationship between web tension and drive speed in a tension zone of the web press of FIG. 1 or FIG. 2 operated in a tension control mode in accordance with an embodiment of the present disclosure.

Considering now in further detail the tension control mode of operation of a tension zone of the press, and with further reference to FIG. 3, this mode maintains the tension of the web of media in a particular tension zone at a single, given setpoint 32. The tension setpoint 32 is a value that is sufficiently high so as to allow the web of media to run smoothly through the press with proper print registration of all colors on both sides of the media, but not high enough to cause the web of media to tear or rip from excessive tension.

FIG. 3 illustrates an example relationship between web tension and drive speed in a tension zone, such as tension zone 8, when operating in the tension control mode. As the web tension, measured by tension sensor 14, deviates from the setpoint 32, the speed of the drive 10 is adjusted by the controller 16 so as to bring the web tension back to the setpoint 32. For example, if the web tension increases above the setpoint 32 the drive speed is decreased, while if the web tension decreases below the setpoint 32 the drive speed is increased. In some embodiments, the controller 16 implements closed-loop PID control to maintain the tension setpoint 32, changing the drive speed based on feedback from the tension sensor 14.

The operations performed by various processing stations, such as stations 25, 26*a-b*, 27*a-b*, and 25 of the press 20, can cause the tension in the web to deviate from the setpoint 32 by changing the mechanical properties of the media. For example, a printing station 26*a-b* that prints a water-based ink onto the web of media 5 can cause water-absorbing media such as paper to become stretchy or pliable and/or to expand or swell, which then decreases the tension in the web 5. Conversely, a drying station 27*a-b* that removes water from the web of media 5 by, for example, heating and evaporation can cause the media to shrink and tighten, which increases the tension in the web. The content of the print job typically varies; for example, a certain number of linear feet of content that are printed with a nominal print density, such as text, may be followed by another number of feet of high print density, graphics-intensive content that deposits considerably more ink to the web of media 5. In this situation, the web tension in a zone will change as the moisture content of the media in the zone changes. When this occurs, a corresponding change in the speed of the drive 10 is required in order to maintain the tension at the desired setpoint 32.

However, the variations in drive speed that occur when operating the press in tension control mode can degrade the quality of the printed output printed in the tension control mode. For example, an undesirable alignment variation between the various ink colors can occur. This can result in unacceptable print job output that must be rejected, wasting large amounts of media, ink, and time.

Figure 4:
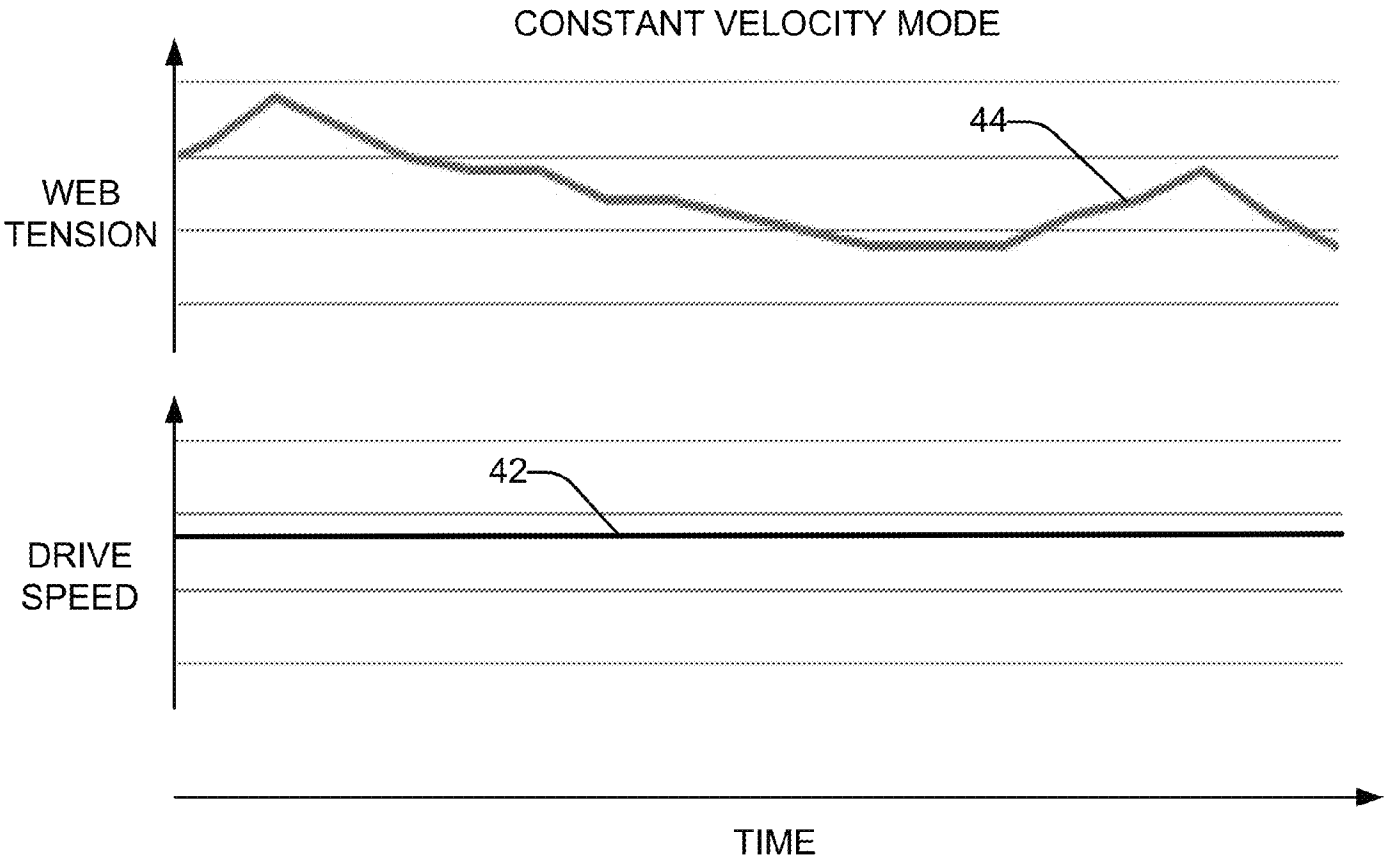
FIG. 4 is an illustration of an example relationship between web tension and drive speed in a tension zone of the web press of FIG. 1 or FIG. 2 operated in a constant velocity mode in accordance with an embodiment of the present disclosure.

In order to maximize print quality and produce acceptable print job output, it is desirable to operate tension zones of the press in a constant velocity mode, as understood with reference to FIG. 4, rather than in a tension control mode. By operating the drive for the tension zone at a single, given speed 42, print quality issues associated with variations in drive speed are minimized or eliminated.

FIG. 4 illustrates an example relationship between web tension and drive speed in a particular tension zone, such as tension zone 8, when operating in the constant velocity mode. As the print job is performed and the ink is deposited on the media at different densities at different times, the tension 44 will vary. As a result, the drive speed chosen must be fast enough to allow the web of media 5 to run smoothly through the press with proper print registration of all colors on both sides of the media, but not so fast as to cause the web of media 5 to tear or rip from excessive tension.

However, determining the proper speed 42 in constant velocity mode for each tension zone of the press for a particular print job usually requires iterative, trial-and-error adjustments performed manually by a skilled operator capable of properly judging the operation of the press. The speed of each drive in an upstream zone has a ripple effect on the speed of the drive in each downstream zone that must be taken into account. Unfortunately, the stretching and shrinking effects of the processing stations in each zone on the media preclude a simple derivation of downstream drive speeds from upstream ones, particularly where the print density of the printed content varies. As a result, hundreds or even thousands of feet of web media may be run through the press and wasted before the proper settings are determined, with a significant amount of time, in some cases 15 to 20 minutes or even more, expended in doing so.

Figure 5:
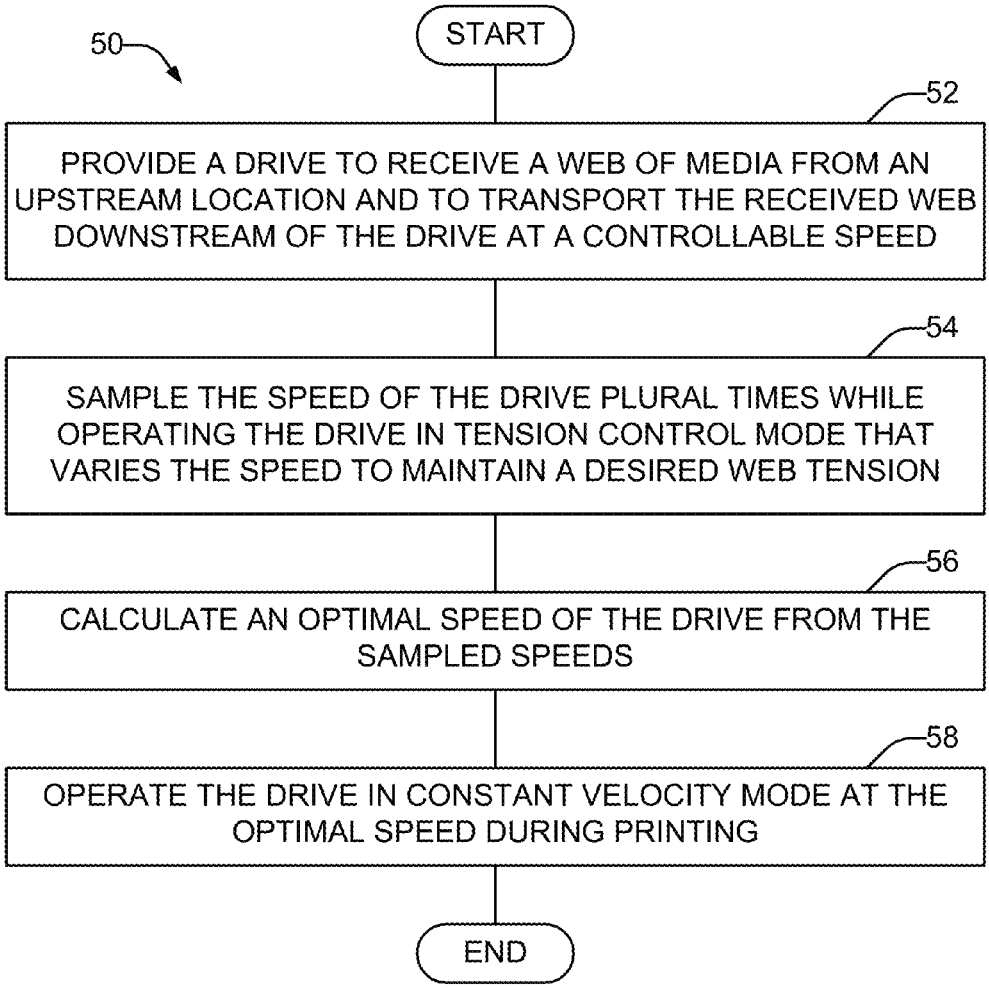
FIG. 5 is a schematic flow diagram, in accordance with an embodiment of the present disclosure, for controlling drive settings in a web press and determining an optimal drive speed.

Consider now, with reference to FIG. 5, a schematic flow diagram for controlling drive settings in a web press. The schematic flow diagram may be considered as a flowchart of an embodiment of a method of operation of the web press. Alternatively, at least some of the blocks in the schematic flow diagram may be considered as steps in an embodiment of a method implemented in the processor 18 of the controller 16. The method 50 automatically determines an optimal speed for a drive 10 when operating a tension zone 8 of a web press in the constant velocity mode. The method 50 advantageously allows the press to be operated by other than a skilled operator. The method 50 also advantageously determines the optimal speed for a drive 10 more quickly than can be done by a skilled operator, and runs fewer feet of web media through the press in doing so.

The method 50 includes a block 52 that provides a drive 10 configured to receive a web of media 5 from an upstream location, and that transports the received web 5 downstream of the drive 10 at a controllable speed. At block 54, the speed of the drive 10 is sampled a plurality of times while operating the drive 10 in a tension control mode that varies the speed in order to maintain a desired tension in the web 5 adjacent the drive 10. In some embodiments, data having an ink density that corresponds to the ink density of a particular print job is printed to form test output while operating in the tension control mode and sampling the speeds. The print data may be the particular print job itself. Alternatively, the print data may be a print pattern different from the particular print job but representative of the ink density of the particular print job. For example, a user might specify the ink density of the particular print job to the web press as a point on a range from very low to very high, and a print pattern, such as color lines, having the corresponding ink density will then be printed. In a press 20 that has multiple cascaded tension zones which include print section processing stations 26*a-b*, a different ink density may be specified for each print section processing station 26*a-b* in order to indicate, for example, that more printing will be performed on one side of the web than on the other side. Where a print job has a mix of different ink densities—for example, a pattern of high ink density followed by low ink density—the user may specify a medium ink density for the print pattern. At block 56, an optimal speed of the drive 10 is calculated from the sampled speeds. At block 58, the drive 10 is operated in a constant velocity mode at the optimal speed during printing of a desired print job on the web of media 5.

Figure 6:
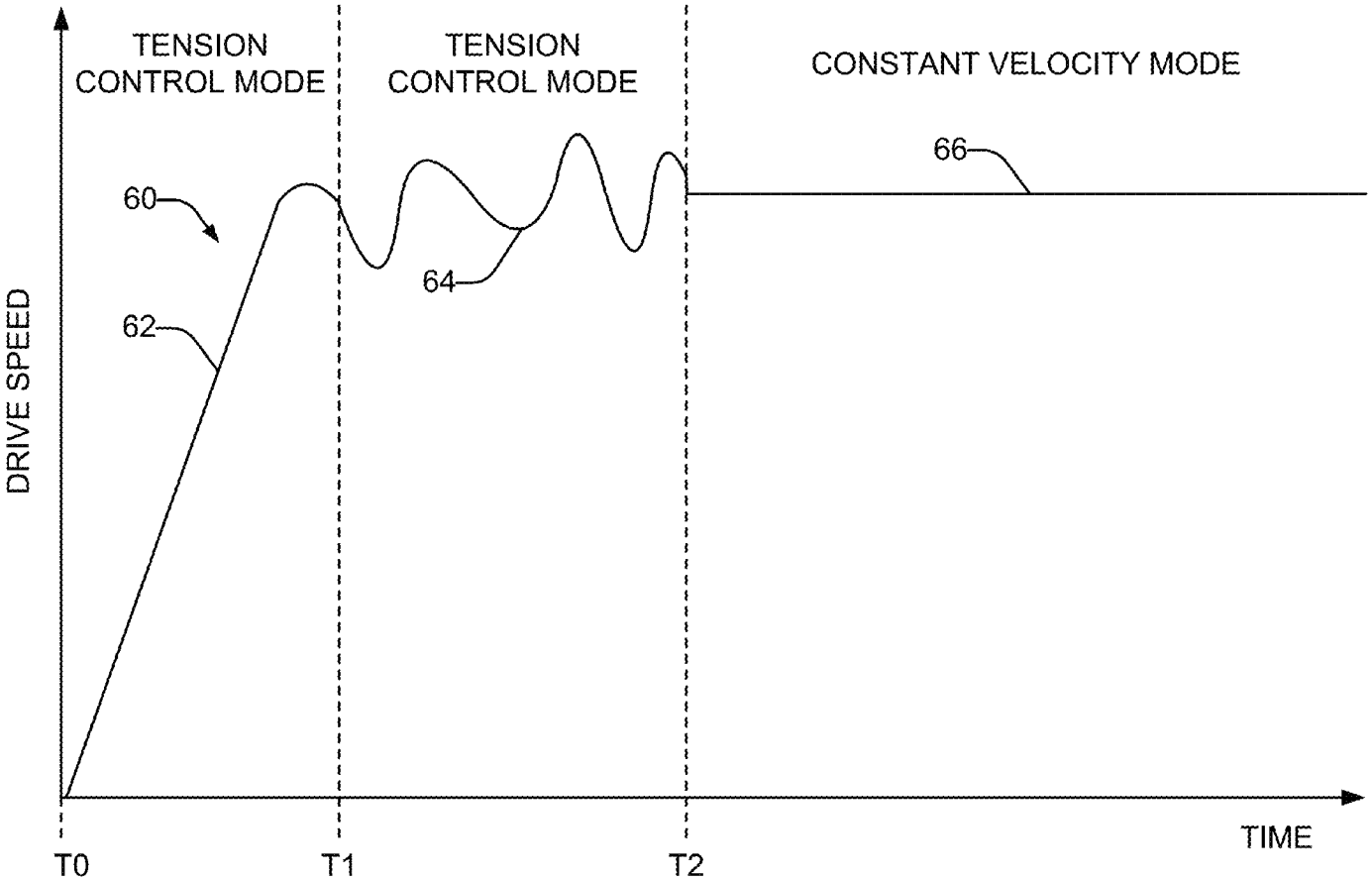
FIG. 6 is a schematic representation of an example drive speed in a tension zone of the web press of FIG. 1 or FIG. 2 operated in accordance with the method of FIG. 5, according to an embodiment of the present disclosure.

The operation of the web press to automatically determine an optimal speed for a drive 10 when operating a tension zone 8 of a web press in the constant velocity mode can be further understood with reference to FIG. 6, which illustrates an example schematic representation of the speed 60 of a drive in a tension zone of the web press as the press is first started up, then the optimal speed determined, and finally operated using the optimal speed. This operation may be associated with an initial run of the press for a particular print job. Prior to time T0, the press is not operating; in other words, the drive 10 is not rotating and the web of media 5 is not moving through the press. At time T0, the press is set to closed-loop tension control mode, a tension setpoint is established, and the speed 60 of the drive is ramped up by the controller 16, in a segment 62, to the vicinity of an initial desired speed, consistent with the tension setpoint. After allowing a period of time—for example, about 2 seconds—for the media flow to stabilize, the press then begins printing data having an ink density that corresponds to the ink density of the particular print job, and an additional period of time—for example, about 5 seconds—may be allowed in order for the system to stabilize by, for example, allowing printed media to completely replace blank media in a given tension zone.

From time T1 to time T2, while the press is printing the data having an ink density that corresponds to the ink density of the particular print job, the speed of the drive is varied as necessary by the controller 16 in order to maintain the tension setpoint. Also between times T1 and T2, the speed of the drive 10 is sampled. In some embodiments, the speed is sampled at periodic intervals. In one embodiment, the time between T1 and T2 is about 10 seconds, and the interval period is between about 30 to 50 milliseconds. In other embodiments, the T1-T2 time and/or the interval period may be different. In some embodiments the controller 16 knows the drive speed at the sampled time, since the controller 16 previously sent the speed signal 13 to the drive 10. In other embodiments, the controller 16 may read the speed from the drive 10.

From the sampled speeds, an optimal speed 66 for the drive 10 is calculated. In some embodiments, the sampled speeds are averaged to determine the optimal speed 66, by summing all the sampled speeds and then dividing by the number of samples. Other techniques such as, for example, regression or the discarding of outlier samples may be used to determine the optimal speed 66 in other embodiments. The optimal speed 66 may be different from the final speed of the drive in the tension control mode. In some embodiments, the change from the final speed in the tension control mode to the optimal speed 66 in the constant velocity mode is made substantially instantaneously.

In a press that has multiple cascaded tension zones, the sampling and calculation of an optimal speed 66 is performed separately for each zone. In absolute terms, the T1 and T2 times are typically different for each of the cascaded zones. For purposes of illustration, assume that a web press 20 has five cascaded tension zones B through F, the media travels 6 feet in each zone, and the press is running at a nominal 360 feet per minute (6 feet per second). Thus a given point on the web of media 5 enters a downstream tension zone about 1 second after entering the immediately upstream tension zone. So, considering time T1 of tension zone B as time=0, time T1 of tension zone C occurs at time=~1 second, time T1 of tension zone D occurs at time=~2 seconds, time T1 of tension zone E occurs at time=~3 seconds, and time T1 of tension zone F occurs at time=~4 seconds. The 10 second speed sampling for all zones is completed last in tension zone F, at time=~13 seconds. The timing of the cascading is programmable, and can be modified as desired, in the web press.

At time T2, after the optimum speed 66 has been calculated for a particular tension zone 8, the controller 16 sets the drive 10 for that tension zone 8 to the optimum speed 66 determined for that zone 8, and changes the operation of the zone 8 from the tension control mode to the constant velocity mode. After time T2, the drive speed in that zone 8 is maintained at the optimum speed 66 during printing. In a press 20 that has multiple cascaded tension zones, time T2 for setting the optimum speed 66 for the drive and initiating constant velocity mode cascades through the zones in a similar manner as described above for time T1.

In some embodiments, calibration operations, such as color-to-color registration, may be performed in an initial period after time T2. When the calibration operations have been completed, in some embodiments the controller 16 initiates a shutdown of the press by changing from the constant velocity mode to the tension control mode and performing a controlled deceleration of the drives in the press until movement of the web 5 is brought to a halt. In other embodiments, after the calibration operations have been completed the desired print job is printed in the constant velocity mode in order to achieve high print quality output.

In some embodiments, the optimum speeds calculated for the drives 10 may be saved. The controller 16 may save the optimum speeds in the memory 19, or cause them to be saved or stored in an external memory device (not shown) that is communicatively coupled to the controller 16. The optimum speeds may be stored collectively as a file, or "recipe", for later use. In some embodiments, plural recipes may be saved or stored. In some embodiments, the results of the calibration operations are also stored in the recipe.

Figure 7:
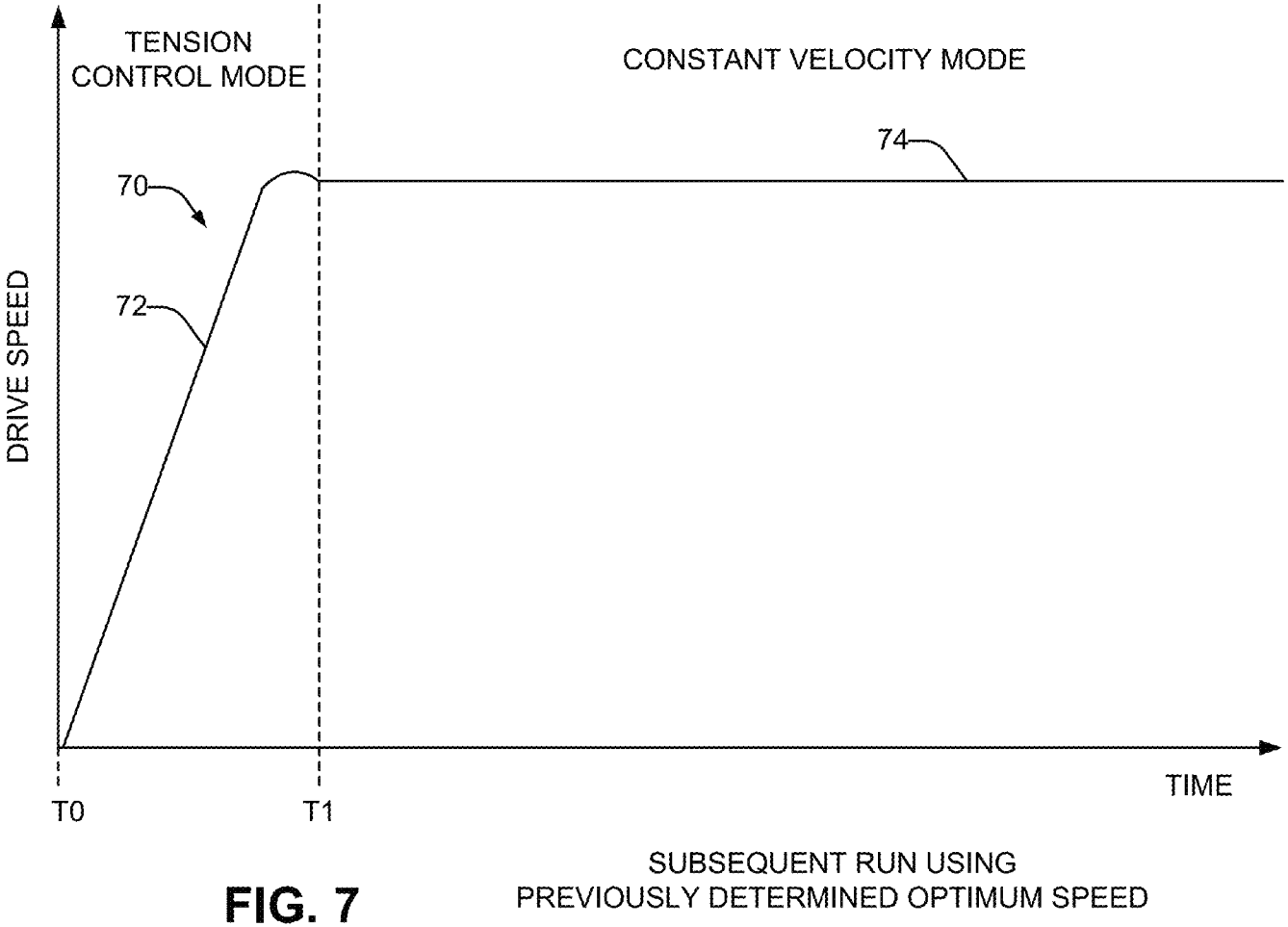
FIG. 7 is a schematic representation of example drive speed in a tension zone of the web press of FIG. 1 or FIG. 2 using an optimal drive speed determined in accordance with the method of FIG. 5, according to an embodiment of the present disclosure.

The operation of the web press to print a print job using a previously determined optimal drive speed for each tension zone can be understood with reference to FIG. 7, which illustrates an example schematic representation of the speed 70 of a drive 10 in a tension zone of the web press as the press is started up, and then as the drive 10 is operated using its associated optimal speed. Such operation may be associated with a subsequent run of the press to print a particular print job for which an initial run to determine the optimal speed has previously been performed, and for which the recipe of optimum speeds has been stored. The controller 16 retrieves the recipe for use during the subsequent run. In some embodiments, the calibration results stored in the recipe are also applied to the press.

Operation during the period from T0 to T1 of the subsequent run is analogous to the same period of the initial run as has been discussed heretofore with reference to FIG. 6. At time T1, after the speed 70 of the drive has been ramped up, in a segment 72, by the controller 16 to the vicinity of an initial desired value and the media flow has stabilized, the zone is switched from the tension control mode to the constant velocity mode, with the speed of the drive 10 set to the optimum speed 74 retrieved from the recipe. The desired print job is then printed in the constant velocity mode, in order to achieve high print quality output. When the print job is complete, the press may be shut down in an analogous manner as has been discussed heretofore with reference to FIG. 6.

Figure 8:
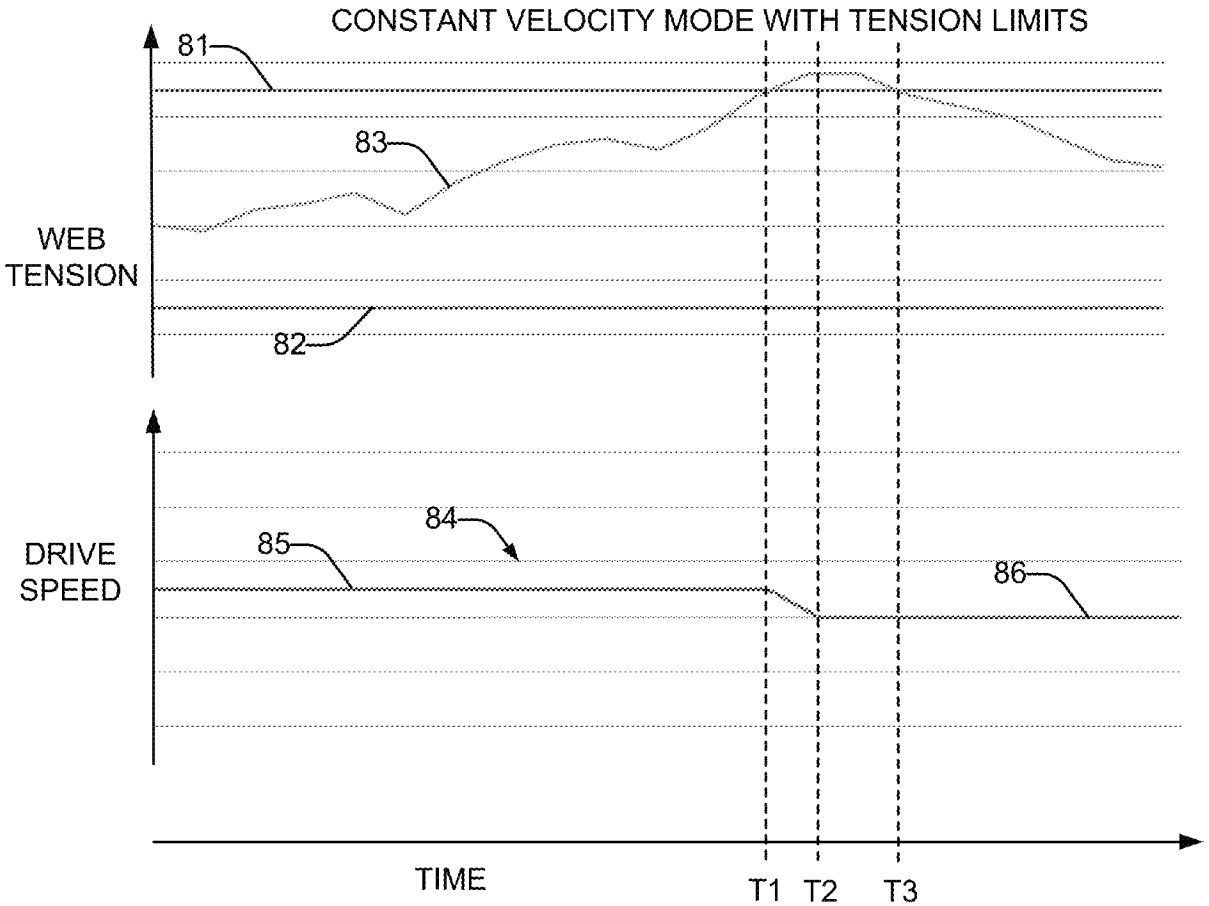
FIG. 8 is an illustration of an example relationship between web tension and drive speed in a tension zone of the web press of FIG. 1 operated in a constant velocity mode with tension limits, in accordance with an embodiment of the present disclosure.

In some situations, the changes in web tension that can occur while operating in constant velocity mode, as discussed heretofore with reference to FIG. 4, may reach unacceptable limits. The tension may become so high that it can cause the web of media to tear or rip, or may become so low that it can prevent the web of media from running smoothly through the press or achieving proper print and color registration. Thus, and with reference to the example relationship illustrated in FIG. 8 between web tension and drive speed in a tension zone of the web press, in some embodiments a drive 10 may be operated in a constant velocity mode that includes upper 81 and lower 82 tension limits. Initially, the drive speed 84 is set to a first level 85. The controller 16 monitors the web tension 83 to determine whether either of the upper 81 or lower 82 tension limits has been exceeded. The term "exceeded" means that the web tension 83 is either higher than the upper limit 81, or lower than the lower limit 82. In one embodiment, the controller 16 monitors the tension sensor 14 about every 20 milliseconds, although the monitoring can be performed at a different rate as well. As long as the tension remains between the upper 81 and lower 82 tension limits, the drive speed 84 remains at the first level 85. However, if the controller 16 detects that the tension 83 has exceeded a limit 81,82, the speed of the drive 10 is adjusted in a manner that causes the tension 83 to return to a value that is within the limits 81,82. For example at time T1 the tension 83 is illustrated as exceeding the upper limit 81, and from time T1 to T2 the controller 16 reduces the drive speed 84 to a second level 86 less than the first level 85. Conversely, if at time T1 the tension 83 would have exceeded the lower limit 82 instead of the upper limit 81, the controller 16 would have increased the drive speed 84 to a second level 86 greater than the first level 85.

In one embodiment, the changes in drive speed from the first 85 to second 86 levels are made over a period of about 1 second, although the changes may be made over other periods as well. While the change in speed from time T1 to T2 is illustrated as a linear ramp, the speed change may be performed in other manners as well. The controller 16 monitors the effect of the change in drive speed 84 on the web tension 83. For example, the controller may determine that, at time T2, the tension 83 has begun to reverse, or that its rate of change has slowed or stopped. Thus the controller 16 maintains the drive speed 84 at the second level 86, while continuing to monitor the tension 83 and ascertain that it once again returns to within the limits 81,82, at time T3. If the controller 16 determines that the change in speed to the second level 86 is insufficient to return the web tension 83 to within the limits 81,82, a further change in drive speed 84 to a different level will be made. Once the web tension 83 has returned within the limits 81,82, the drive speed 84 is maintained at the new level unless and until the tension once again exceeds the limits 81,82.

In a web press 20 with multiple tension zones and multiple drives 10, the tension of each zone is monitored, and the drive speed changed if necessary, independently of the other zones. In other words, a change of speed made in one zone is not accompanied by a change in speed made in other zones. If the speed change in the second zone subsequently goes out of limits due to the speed change that was made in the first zone, the speed in the second zone will be changed independently.

It is noted that operation in the constant velocity mode with tension limits is significantly different from operation in the tension control mode. As has been explained heretofore with reference to FIG. 3, the objective in tension control mode is to maintain the web tension at a single, specified setpoint 32. When the tension 34 deviates from the setpoint 32, the drive speed is quickly changed so as to return the web tension to the setpoint 32. Since even minor changes in tension result in changes in drive speed, the changes in drive speed typically occur much more frequently in tension control mode than in the constant velocity mode with tension limits. These changes in drive speed adversely impact print quality to such an extent that the tension control mode is not usable for printing the print job.

Conversely, operation in a constant velocity mode with tension limits involves not a single setpoint at which tension is maintained, but rather a pair of upper 81 and lower 82 web tension limits. When operating in this mode, even through the tension in the web changes, the drive is advantageously maintained at a fixed speed as long as the tension remains within the limits 81,82. These limits typically provide a wide range of allowable web tension. For example, a target tension guideline is associated with each different type of web media. In some embodiments, the upper limit is set to three times the target tension, and the lower limit is set to one-third of the target tension. So if, for example, the target tension for a particular media is specified to be 30 pounds, the upper tension limit 81 is set to a tension sensor value corresponding to 90 pounds, and the lower tension limit 82 is set to a tension sensor value corresponding to 10 pounds. Within these tension limits, the media will flow smoothly through the press and avoid tearing. The span of acceptable tension between the limits 81,82 allows the drive speed 84 to be maintained at a constant level for long periods of time at the optimal drive speed that has been determined, resulting in high quality printed output being produced by the press.

In some embodiments, different tension zones may be assigned different behaviors when the tension limits 81,82 are exceeded. For example, a speed change in some zones, such as zone D of web press 20 that includes turn bar 25, may compromise print quality more than a speed change in other zones. Accordingly, exceeding the tension limits 81,82 in such a zone may result in the press 20 being stopped, rather than continuing to operate at a changed speed.

In some embodiments, the changes in drive speed for the tension zones that occur during operation in the constant velocity mode with tension limits are not saved in the recipe. The operator of the press may be informed whenever such drive speed changes occur, and may instead choose to stop and perform another initial run that will determine new optimum speeds.

In alternative embodiments, the changes in drive speed for the tension zones that occur during operation in the constant velocity with tension limits mode may be saved in the recipe. The changed speeds may replace the original optimum speeds. Or, the changed speed may be stored in addition to the original optimum speeds, along with the running time at which the change in speed occurred, for application during the subsequent runs.

Figure 9:
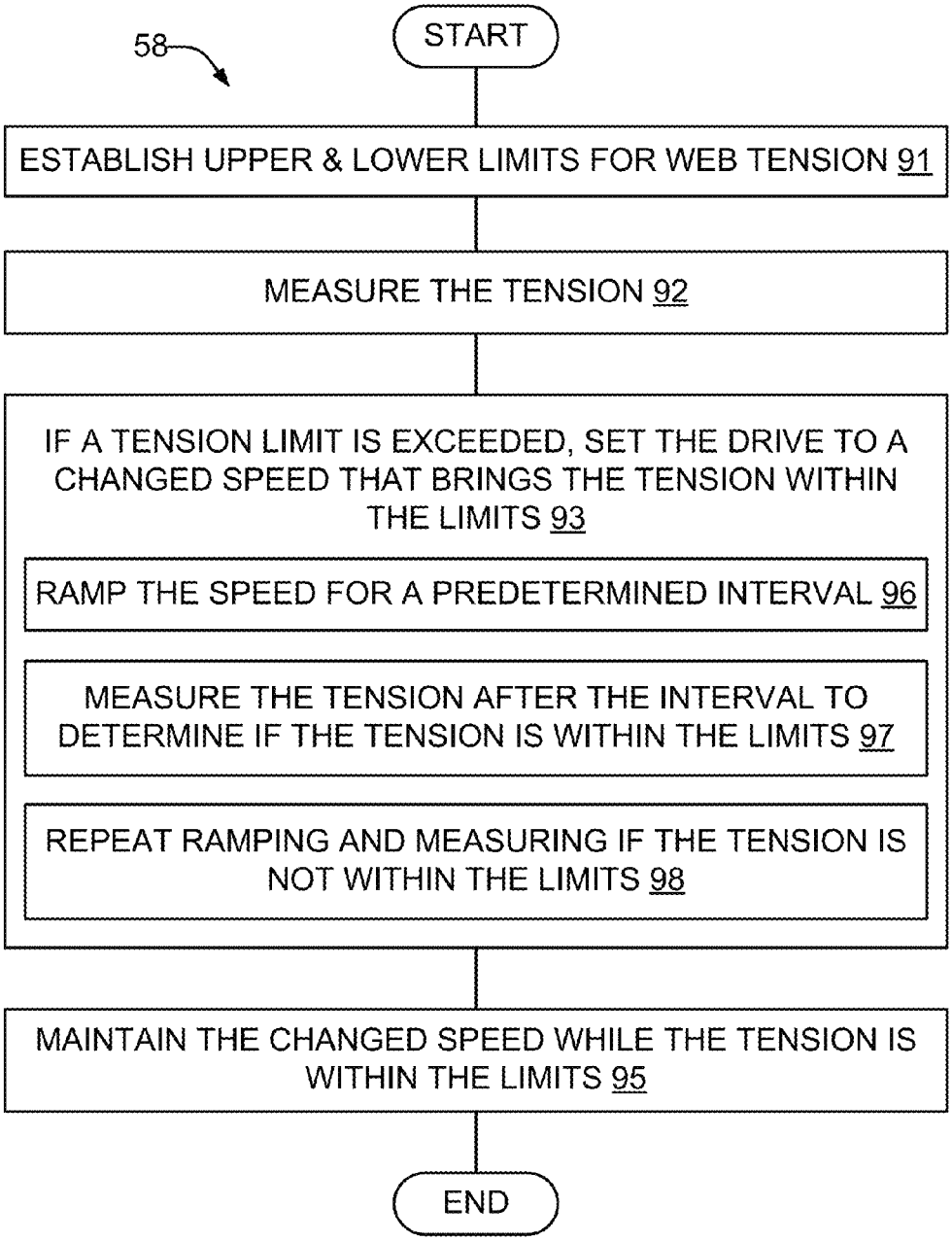
FIG. 9 is a lower-level schematic flow diagram of a portion of FIG. 5 for operating the web press of FIG. 1 in the constant velocity mode with tension limits of FIG. 8, in accordance with an embodiment of the present disclosure.

Consider now, with reference to FIG. 9, a schematic flow diagram of one embodiment of block 58 of FIG. 5. The schematic flow diagram may be considered as a flowchart of an embodiment of a method that operates the drive in the constant velocity mode at the optimum speed during printing. Alternatively, the blocks in the schematic flow diagram may be considered as steps in an embodiment of a method implemented in the processor 18 of the controller 16. Block 58 implements a constant velocity mode with tension limits for a tension zone of the web press. At block 91, upper and lower limits for web tension in the constant velocity mode are established. At block 92, the web tension is measured. At block 93, if either of the tension limits is exceeded, the drive is set to a changed speed that brings the web tension within the upper and lower limits. At block 95, the drive is maintained at the changed speed while the web tension is within the upper and lower limits.

One embodiment of block 93 for setting the drive to a changed speed that brings the web tension within the upper and lower limits begins, at block 96, by changing the speed of the drive over a predetermined interval of time. At block 97, the web tension is measured after the predetermined interval to determine if the web tension is within the upper and lower limits. At block 98, if the web tension is not within the upper and lower limits, the changing and the measuring of blocks 96-97 are repeated until the web tension is within the upper and lower limits.

Figure 10A:
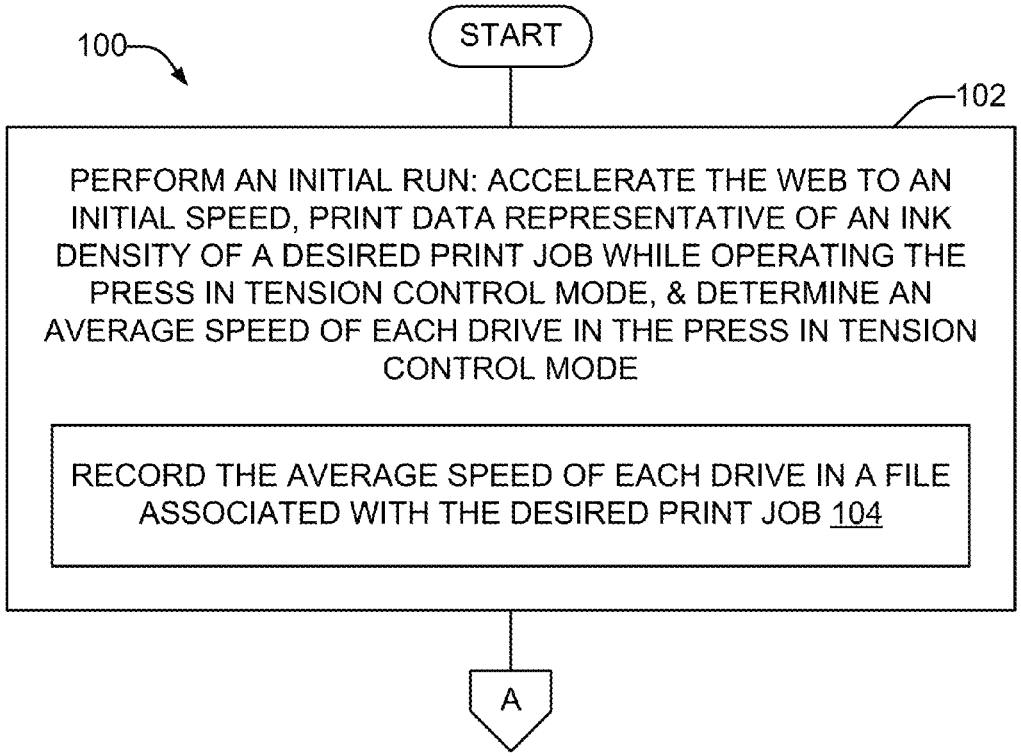
FIGS. 10A-10B are schematic flow diagrams, in accordance with an embodiment of the present disclosure, of a method of operating a web press that performs an initial run and a subsequent run.
Figure 10B:
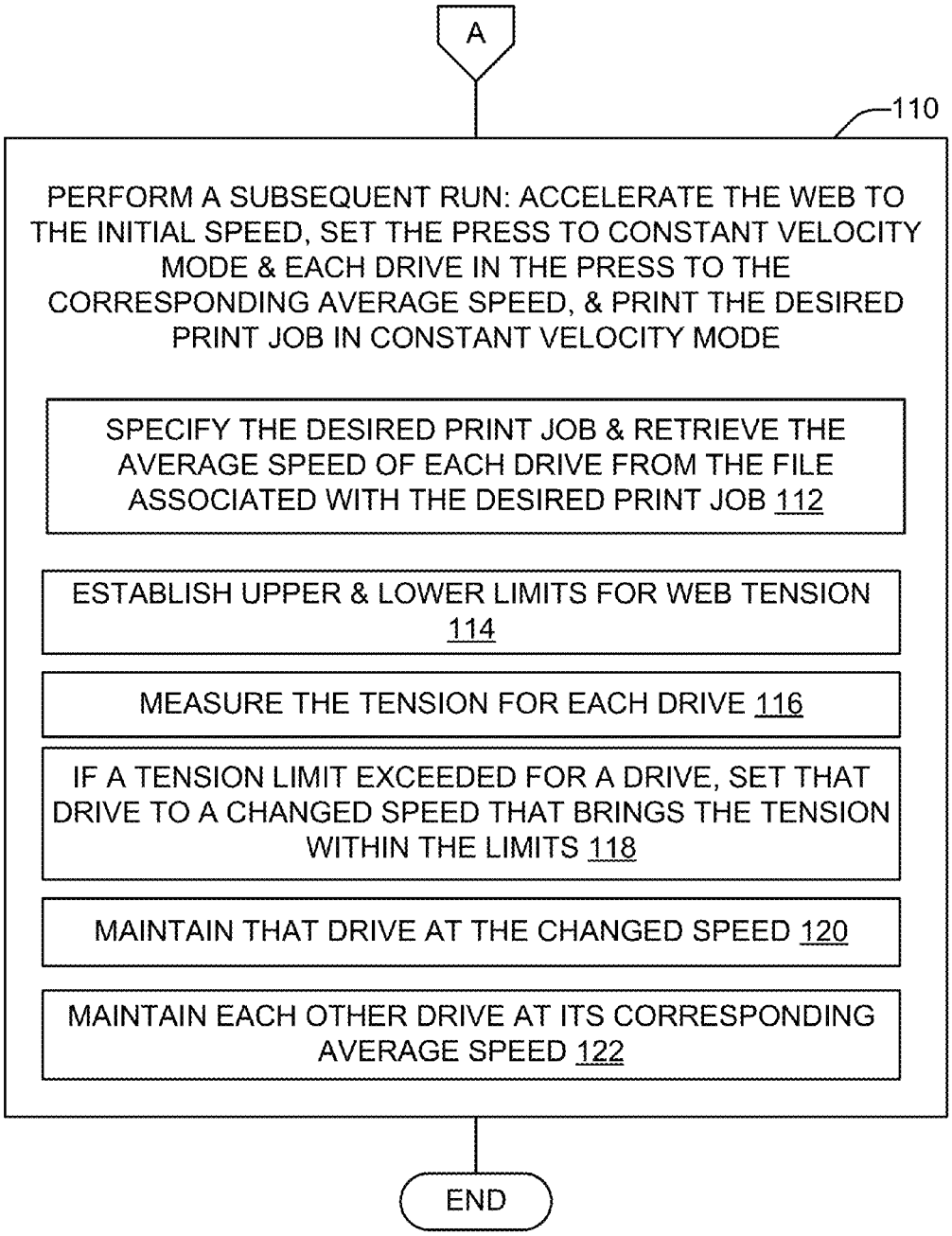

FIGS. 10A-10B are schematic flow diagrams, in accordance with an embodiment of the present disclosure, of a method of operating a web press that performs an initial run and a subsequent run. The schematic flow diagrams may be considered as a flowchart of an embodiment of a method of operation of the web press. Alternatively, at least some of the blocks in the schematic flow diagram may be considered as steps in an embodiment of a method implemented in the processor 18 of the controller 16. The method 100 automatically determines, in the initial run, an optimal speed—such as, for example, an average speed—for each drive 10 while operating the tension zones of a web press in the tension control mode. Then a subsequent run prints a desired print job on the web press while operating tension zones of the press in the constant velocity mode, with each drive set to the optimal speed for that drive 10 that was calculated in the initial run.

The method 100 includes a block 102 that performs an initial run that includes accelerating the web to an initial speed; after the accelerating, printing data representative of an ink density of a desired print job while operating the press in a tension control mode; and determining an average speed of each drive in the press in the tension control mode. Then, at a block 110, a subsequent run is performed that includes accelerating the web to the initial speed; after the accelerating, setting the press to a constant velocity mode and each drive in the press to the corresponding average speed determined during the calibration run; and printing the desired print job with the press in the constant velocity mode.

In some embodiments, the block 102 includes recording 104 the average speed of each drive in a file associated with the desired print job. In some embodiments, the block 110 includes specifying 112 the desired print job and retrieving the average speed of each drive from the file associated with the desired print job.

In some embodiments, the block 110 includes establishing 114 upper and lower limits for web tension in the constant velocity mode; measuring 116 the web tension; if either of the tension limits is exceeded, setting 118 the drive to a changed speed that brings the web tension within the upper and lower limits; maintaining 120 the drive at the changed speed; and maintaining 122 each other one of the drives at its corresponding average speed.

From the foregoing it will be appreciated that the press and methods provided by the present disclosure represent a significant advance in the art. Although several specific embodiments have been described and illustrated, the invention is not limited to the specific methods, forms, or arrangements of parts so described and illustrated. This description should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Unless otherwise specified, steps of a method claim need not be performed in the order specified. The disclosure is not limited to the above-described implementations, but instead is defined by the appended claims in light of their full scope of equivalents. Where the claims recite "a" or "a first" element of the equivalent thereof, such claims should be understood to include incorporation of one or more such elements, neither requiring nor excluding two or more such elements. Terms of orientation and relative position (such as "top," "bottom," "side," and the like) are not intended to require a particular orientation of any element or assembly, and are used only for convenience of illustration and description.

What is claimed is:

1. A method for controlling drive settings in a press for printing on a web of media, comprising:

providing a drive to receive the web from an upstream location and to transport the received web downstream of the drive at a controllable speed;

sampling the speed of the drive plural times while operating the drive in a tension control mode that varies the speed to maintain a desired tension in the web adjacent the drive;

calculating an optimal speed of the drive from the sampled speeds; and operating the drive in a constant velocity mode at the optimal speed during printing.

2. The method of claim 1, wherein the optimal speed is calculated by averaging the sampled speeds.

3. The method of claim 1, wherein at least two of the sampled speeds are different.

4. The method of claim 1, wherein the optimal speed of the drive is different from the final speed of the drive in the tension control mode.

5. The method of claim 1, wherein the speed of the drive is sampled periodically in the tension control mode.

6. The method of claim 1, comprising:

while operating in the tension control mode, printing data having an ink density corresponding to an ink density of a particular print job.

7. The method of claim 6, wherein the data is a print pattern different from the particular print job.

8. The method of claim 6, wherein the data is the particular print job.

9. The method of claim 1, comprising:

establishing upper and lower limits for web tension in the constant velocity mode;

measuring the web tension;

if either of the tension limits is exceeded, setting the drive to a changed speed that brings the web tension within the upper and lower limits; and maintaining the drive at the changed speed while the web tension is within the upper and lower limits.

10. The method of claim 9, wherein setting the drive to a changed speed that brings the web tension within the upper and lower limits comprises:

changing the speed over a predetermined interval;

measuring the web tension after the predetermined interval to determine if the web tension is within the upper and lower limits; and repeating the changing and the measuring if the web tension is not within the upper and lower limits.

11. The method of claim 1, wherein the drive transports the received web downstream to a second drive, the method including:

sampling the speed of the second drive plural times while operating the press in the tension control mode; and calculating a second optimal speed of the second drive from the sampled speeds of the second drive; and operating the second drive in the constant velocity mode at the second optimal speed during printing.

12. A press for printing on a web of media, comprising:

a drive to receive the web from an upstream location and advance the received web downstream at a controllable speed;

a tension sensor to measure tension in the web adjacent the drive;

a controller to sample the speed of the drive plural times while operating the drive in a tension control mode that varies the speed to maintain a desired tension, calculate an optimal speed of the drive from the sampled speeds, and set the drive to the optimal speed in a constant velocity mode while printing desired output on the web.

13. The press of claim 12, wherein the desired output has an associated ink density, and wherein the controller prints test output having the ink density while operating the drive in the tension control mode.

14. The press of claim 12, wherein the optimal speed is calculated by averaging the sampled speeds.

15. The press of claim 12, wherein the controller is further configured to:

establish upper and lower limits for the tension in the web in the constant velocity mode;

measure the web tension with the tension sensor;

if the measured web tension exceeds either of the tension limits, set the drive to a changed speed that brings the web tension within the upper and lower limits; and maintain the drive at the changed speed while the web tension is within the upper and lower limits.

16. The press of claim 12, comprising:

a second drive downstream of the drive to receive the web from the drive, wherein the controller is further configured to sample the speed of the second drive plural times while operating the second drive in the tension control mode; and calculate a second optimal speed of the second drive from the sampled speeds of the second drive; and set the second drive to the second optimal speed in a constant velocity mode while printing desired output on the web.

17. A method for operating a press for printing on a web of media, comprising:

performing an initial run that includes accelerating the web to an initial speed, after the accelerating, printing data representative of an ink density of a desired print job while operating the press in a tension control mode, and determining an average speed of each drive in the press in the tension control mode; and performing a subsequent run that includes accelerating the web to the initial speed, after the accelerating, setting the press to a constant velocity mode and each drive in the press to the corresponding average speed, and printing the desired print job with the press in the constant velocity mode.

18. The method of claim 17, comprising:

establishing upper and lower limits for tension in the web in the constant velocity mode;

measuring a web tension associated with each drive;

if the measured web tension exceeds either of the tension limits in the constant velocity mode for a particular one of the drives, setting the particular drive to a changed speed that brings the web tension within the upper and lower limits; and maintaining the particular drive at the changed speed in the constant velocity mode while the web tension is within the upper and lower limits.

19. The method of claim 18, comprising:

maintaining each other one of the drives at its corresponding average speed in the constant velocity mode.

20. The method of claim 17, wherein performing the initial run includes recording the average speed of each drive in a file associated with the desired print job, and wherein performing the subsequent run includes specifying the desired print job and retrieving the average speed of each drive from the file associated with the desired print job.

* * * * *